US010400590B1

(12) United States Patent
Aldred

(10) Patent No.: US 10,400,590 B1
(45) Date of Patent: Sep. 3, 2019

(54) METHOD AND SYSTEM FOR DETERMINING A DISTRIBUTION OF ROCK TYPES IN GEOLOGICAL CELLS AROUND A WELLBORE

(71) Applicant: Emerson Paradigm Holding LLC, Houston, TX (US)

(72) Inventor: Rick Aldred, Queensland (AU)

(73) Assignee: Emerson Paradigm Holding LLC, Houston, TX (US)

( * ) Notice: Subject to any disclaimer, the term of this patent is extended or adjusted under 35 U.S.C. 154(b) by 310 days.

(21) Appl. No.: 15/295,009

(22) Filed: Oct. 17, 2016

Related U.S. Application Data

(60) Provisional application No. 62/242,496, filed on Oct. 16, 2015.

(51) Int. Cl.

| | |
|---|---|
| ***E21B 49/00*** | (2006.01) |
| ***E21B 49/02*** | (2006.01) |
| *E21B 47/024* | (2006.01) |
| *E21B 7/04* | (2006.01) |

(52) U.S. Cl.
CPC ..... *E21B 49/00* (2013.01); *E21B 49/02* (2013.01); *E21B 7/04* (2013.01); *E21B 47/024* (2013.01); *E21B 49/005* (2013.01)

(58) Field of Classification Search
CPC ..... G01V 11/00; G01V 2210/6163
See application file for complete search history.

(56) References Cited

U.S. PATENT DOCUMENTS 7,149,672 B2 * 12/2006 Torkildsen ..... G01V 11/00 703/10
8,165,817 B2 * 4/2012 Betancourt ..... G01V 11/00 702/13

OTHER PUBLICATIONS

Quirein et al., "A Coherent Framework for Developing and Applying Multiple Formation Evaluation Models", Presented at the SPWLA Annual Logging Symposium, 1986, Houston, Texas.
Ye et al., "A New Tool for electrofacies Analysis: Multi-Resolution Graph-Based Clustering", Presented at SPWLA Annual Logging Symposium, 2000, Dallas, Texas.
Passey et al., "Petrophysical Evaluation of Hydrocarbon Pore-Thickness in Thinly Bedded Clastic Reservoirs", pp. 133-153, 173-190, AAPG Archie Series No. 1., 2006, AAPG, Tulsa, Oklahoma.
Voss et al., "Common Stratigraphic Framework to Simulate Well Logs and to Cross-Validate Static and Dynamic Petrophysical Interpretations", Presented at SPWLA Annual Logging Symposium, 2009, Woodlands, Texas.
Mollison et al., "A Model for Hydrocarbon Saturation Determination From an Orthogonal Tensor Relationship in Thinly Laminated Anisotropic Reservoirs", Presented at SPWLA Annual Logging Symposium, 1999, Oslo, Norway.
(Continued)

*Primary Examiner* — Elias Desta
(74) *Attorney, Agent, or Firm* — Pearl Cohen Zedek Latzer Baratz LLP

(57) ABSTRACT

A method includes acquiring measurement data from a plurality of measurements corresponding to different depths within a wellbore. Using a processor, a distribution of rock types in each cell of a plurality of geological cells around the wellbore is determined from the measurement data. Petrophysical characteristics of each cell of the plurality of geological cells are calculated from the distribution of rock types.

14 Claims, 4 Drawing Sheets

(56) References Cited

OTHER PUBLICATIONS

Georgi et al., "On the Relationship between Resistivity and Permeability Anisotropy", Presented at the SPE Annual Technical Conference and Exhibition, 2002, San Antonio, Texas.
Thomeer, "Introduction of a Pore Geometrical Factor Defined by the Capillary Pressure Curve", *SPE I Pet Technol*, Mar. 1960, pp. 73-77.

* cited by examiner

METHOD AND SYSTEM FOR DETERMINING A DISTRIBUTION OF ROCK TYPES IN GEOLOGICAL CELLS AROUND A WELLBORE

CROSS-REFERENCE TO RELATED APPLICATIONS

This application claims the benefit of U.S. Provisional Patent Application No. 62/242,496 filed on Oct. 16, 2015, which is incorporated herein by reference in its entirety.

FIELD OF THE INVENTION

Embodiments of the present invention relate to petrophysics. More specifically, embodiments of the present invention relate to methods and systems for determining a distribution of rock types in geological cells around a wellbore.

BACKGROUND OF THE INVENTION

Petrophysics deals with the exploration and development of oil and gas reservoirs. It also involves the evaluation of potential reservoirs for water production and the storage of carbon dioxide and also for the generation of geothermal power. A general workflow for characterizing and modeling the reservoirs first involves defining regions, which are likely to have hydrocarbon reservoirs. Seismic surveys are used to define sub-surface structures, which may have reservoirs. Wells are drilled through those structures. Measurements from the drilled wells are then used to assess the rock formation in the reservoir to determine hydrocarbon content. Reservoir models are then built based on the geological, geophysical, and petrophysical information of the reservoir. Reservoir engineers use these models to plan oil production from the reservoir. Once a reservoir has been identified and oil production from the well has been determined to be economically viable, additional wells are drilled in the reservoir and the reservoir model is further refined as more information becomes available.

SUMMARY OF EMBODIMENTS THE INVENTION

There is provided, in accordance with some embodiments of the present invention, a system and a method for acquiring measurement data from a plurality of measurements corresponding to different depths within a wellbore; using a processor, determining from the measurement data, a distribution of rock types in each cell of a plurality of geological cells around the wellbore; and calculating petrophysical characteristics of each cell of the plurality of geological cells from the distribution of rock types.

Furthermore, in accordance with some embodiments of the present invention, the plurality of measurements include log measurements at the different depths within the wellbore collected by sensors lowered into the wellbore.

Furthermore, in accordance with some embodiments of the present invention, the plurality of measurements includes measurements made by sensors of a plurality of geological samples removed from the wellbore corresponding to different depths in the wellbore.

Furthermore, in accordance with some embodiments of the present invention, determining the distribution of rock types in each cell of the plurality of geological cells includes assigning coefficients to each rock type within each of the plurality of geological cells; computing an error function including a difference between a petrophysical metric as derived from the measurement data and the petrophysical metric as computed from the coefficients; and minimizing the error function by varying the coefficients.

Furthermore, in accordance with some embodiments of the present invention, calculating the petrophysical characteristics includes using the distribution in each of the plurality of geological cells to compute petrophysical parameters selected from the group consisting of: porosity, permeability, fluid saturation, net pay, and net reservoir.

Furthermore, in accordance with some embodiments of the present invention, the method includes upscaling the determined distribution of rock types in the plurality of geological cells and mapping the upscaled distribution to a reservoir model.

Furthermore, in accordance with some embodiments of the present invention, the method includes computing an angle for drilling a well by using the reservoir model with the upscaled distribution of rock types.

Furthermore, in accordance with some embodiments of the present invention, the method includes outputting a reservoir summary of an oil reservoir by using the reservoir model with the upscaled distribution of rock types.

There is further provided, in accordance with some embodiments of the present invention, a system including a memory; and a processor configured to receive measurement data from a plurality of measurements corresponding to different depths within a wellbore, to determine from the measurement data, a distribution of rock types in each cell of a plurality of geological cells around the wellbore, and to calculate petrophysical characteristics of each cell of the plurality of geological cells from the distribution of rock types.

BRIEF DESCRIPTION OF THE DRAWINGS

In order for the present invention to be better understood and for its practical applications to be appreciated, the following figures are provided and referenced hereafter. It should be noted that the figures are given as examples only and in no way limit the scope of the invention. Like components are denoted by like reference numerals.

DETAILED DESCRIPTION OF EMBODIMENTS OF THE INVENTION

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, use of the conjunction "or" as used herein is to be understood as inclusive (any or all of the stated options).

When seismic surveys indicate that sub-surface structures may include hydrocarbon reservoirs, bore holes are drilled through the Earth and into those detected structures. Modern drilling techniques are not limited to vertical boreholes and allow wells to be drilled at any angle from a specific point under the ground, even horizontally. A main benefit of horizontal wells is that the wellbore may be drilled along a specific layer with hydrocarbon-bearing rock increasing the area between the wellbore and the hydrocarbon layer, such that considerably more hydrocarbon may be extracted from the layer.

Figure 1:
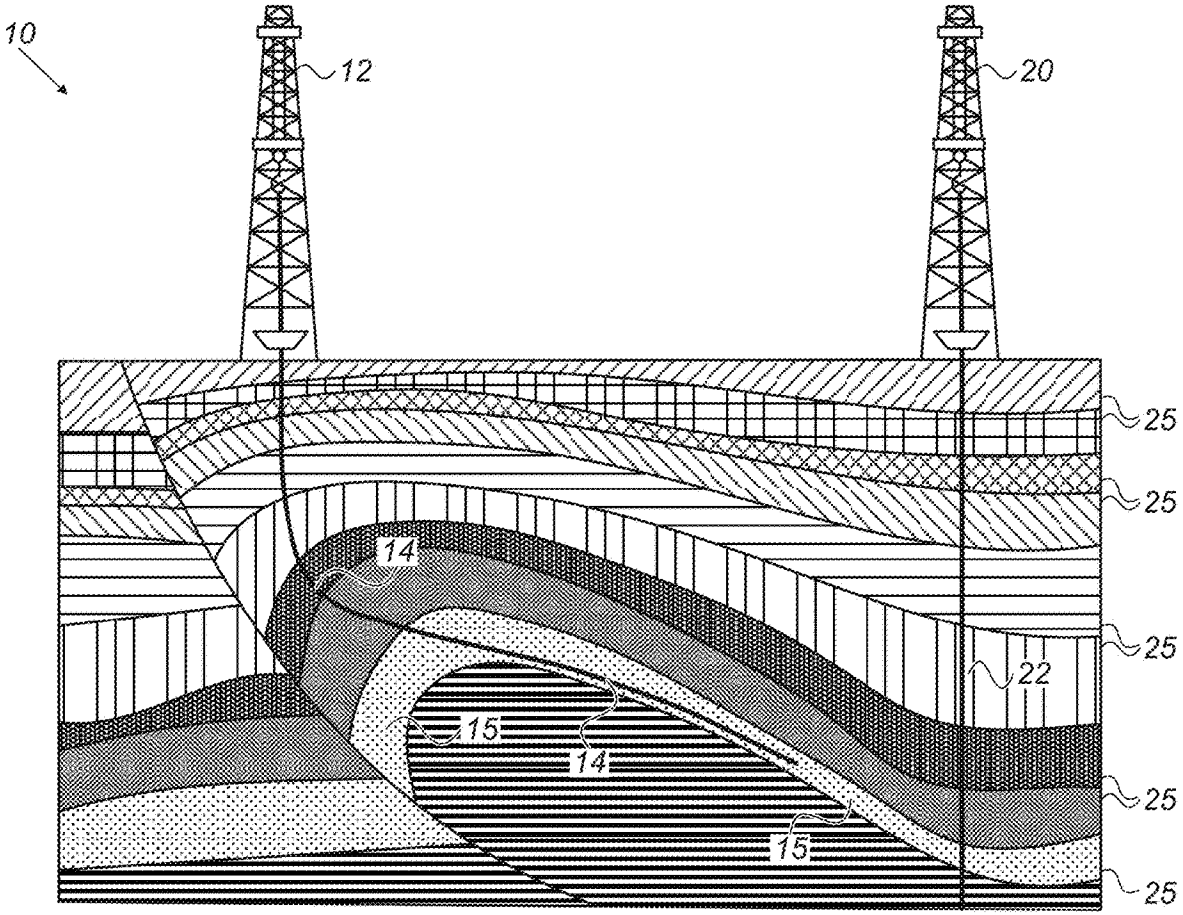
FIG. 1 schematically illustrates an oil drilling field, in accordance with some embodiments of the present invention.

FIG. 1 schematically illustrates an oil drilling field 10, in accordance with some embodiments of the present invention. An oil drilling rig 20 drills a near vertical borehole, or wellbore 22, through reservoir rock layers 25, or strata, some of which may include oil. Similarly, a drilling rig 12 drills a near horizontal wellbore 14 through oil bearing rock layer 15. Wellbore 14 follows the contour of oil bearing layer 15 so as to optimize the amount of oil that can be extracted from layer 15 once oil production begins. The embodiments shown in FIG. 1 are merely for visual clarity and not by way of limitation of the embodiments of the present invention.

Petrophysicists assess the types of reservoir rocks present, the amount of different fluids present in the pore space of the rock, and the ability of those fluids to flow through the rock. There are typically two main classes of measurements that are used by petrophysicists to analyze the reservoir rock. The first class is based on analyzing and interpreting data from a number of sources, including actual rock and fluid samples collected from different depths in the wellbore and removed during the drilling process. These samples corresponding to different depths in the wellbore are analyzed by different sensors and measuring devices external to the wellbore. The second class of measurements is known as well logging, where measurements are made by lowering sensors and various different types of devices called logging tools into the wellbore, and taking measurements at different depths. All of the sensors, logging tools and measuring devices described above are known herein as sensors.

Some examples of measurement and logging tools may include recording the natural radioactivity in the rocks. Other tools may determine the electron density and the hydrogen content of the rock. Some devices send shock waves through the rock to record how fast those waves travel, while other devices send electric currents into the rock to measure the conductivity of the reservoir rock. In addition, nuclear magnetic resonance (NMR) measurements can be recorded in the well, acoustic scanners and electrical tools can be used to build an actual image around the side of the borehole, and some devices measure the pressure of any fluids present in pore spaces in the rock. All of these measurements are used to characterize and evaluate the rock formation.

Log measurement data may include some or all of the following:

- Gamma ray measurements
- Spectral gamma ray logs of Potassium, Thorium and Uranium and the ratios between them.
- Elemental Capture Spectroscopy including logs of each element tested therefor.
- Spontaneous Potential logs
- Electron Density, bulk density and long/short density error logs, or original count data
- Photoelectric Effect logs
- Thermal and Epithermal Neutron porosity logs, or original counts and ratios.
- Acoustic logs measuring compressional, shear and/or Stoneley slowness, or ratios
- Conductivity/Resistivity measurements including one or more of the following:
  - induction or laterolog measurements, either of which can be individual logs at different depths of investigations or full array logs
  - electromagnetic propagation measurements, both phase shift and attenuation, made at different frequencies
  - tri-axial induction measurements which have been modelled into vertical and horizontal resistivities
- Dielectric measurements
- Nuclear Magnetic Resonance logs, both T1 and T2 arrays, diffusion curves and/or curves of porosity volumes of different pore throat size generated by NMR processing
- Wireline image array logs, based on acoustic and/or resistivity, and log curves of properties derived from their processing
- Wellbore temperature logs
- Wellbore surveying data, including one or more of the following:
  - hole azimuth and deviation for every depth in the well
  - wellbore positioning data, such as start point with offsets in x, y and z directions, relating to a particular reference spheroid
  - calculated true vertical thickness and/or true stratigraphic thickness at each depth
- Depths of free water levels and gas oil contacts for each reservoir unit, or logs of height above free water level for each depth
- User calculated log information from other sources, such as electrofacies analysis
- Porosity logs derived from specific algorithms and other input logs
- Permeability logs generated from processing of data such as NMR, Stoneley Wave, from rock typing including porosity/permeability transforms for different electrofacies, or from probe permeameter on core slabs Similarly, other (non-log) data taken from the core samples or cells taken from the wellbore may include:

- Mud log analysis, including shows, cuttings descriptions etc.
- Core data, such as porosity, permeability in different directions, grain density, etc.
- Minerology information from core samples, such as thin section point count, X-ray diffraction (XRD), Spectroscopy, etc.
- Electrical properties from cores, such as the tortuosity coefficient, the cementation exponent, and the saturation coefficient known respectively as (a, m, n) values, (possibly in different directions)
- Relative permeability data from core test
- Core photographs, both white light and ultra-violet
- Formation water data, including salinity or resistivity at a specific reservoir temperature
- Hydrocarbon data, including density and hydrogen index
- Capillary pressure data, or a saturation height function, derived from the capillary pressure data, along with supporting data, such as fluid properties, that would enable its use in the model
- Formation Pressure data, such as that measured by a Wireline Formation Test (WFT) tool, from which pressure gradients and fluid contacts can be derived
- Fluid mobility data from WFT tests
- Production data, either fluid and flow properties, or continuous production log data
- Production history if in a producing reservoir
- Geological information, including formation tops, spill points, etc.
- Geological section if the modelling is to be used in geosteering applications Petrophysicists may create a model of the reservoir first on a smaller scale in the vicinity immediately around the wellbore. This model is then integrated into the model on a larger scale encompassing the entire reservoir. Similarly, petrophysicists may use an existing model from another well. Unfortunately, typically none of the properties of the reservoir rock, which are used for modelling the reservoir, can be measured directly, so interpretation techniques are used to infer the properties of the reservoir.

The interpretation techniques have many different forms depending on the data available and the formation type being assessed. The two principal modes of interpretation techniques that have dominated petrophysics include deterministic workflows, where individual petrophysical properties are determined in a step-by-step process, and optimizing systems, where log measurements are simultaneously modeled in order to evaluate the composition of the rock in terms of volumes of minerals and fluids.

There are drawbacks in each process. The deterministic process works well in simple rock types, but the step-by-step workflow makes it difficult to adequately define minerals if there are many different minerals present. There are a large number of measurements used to quantify the presence of each different mineral, before the fluid content can even be determined.

Optimizing models start with a 'model' of a complex mix of minerals and fluids. Synthetic logs are calculated as they would respond to that model and these synthetic logs are compared to the actual recorded logs. The relative volumetric content of each of minerals and fluids in the model is then altered to reduce the error, or the difference between the synthetic and actual logs. Using iterative processing and error minimization techniques, an optimized solution is derived which best fits the model to the log measurements. This iterative processing and error minimization is called 'Inversion Processing' as will be shown later.

The drawback of both techniques is that the results tend to be volumes of certain minerals and fluids, with no information regarding the structure of the rock. Reservoir rocks exhibit considerable differences in flow behavior depending on structure. It is useful to know the mineral and fluid components that make up a formation, but that is only a part of the information used for reservoir evaluation and modelling.

Two other issues, which affect both types of log interpretation, are that measurements from different tool types relate to different volumes of rock and that some logs, such as acoustic and resistivity measurements, change depending on the orientation of the measurement. Both of these techniques described above combine all measurements at a specific depth and assume infinite bed thickness and no impact of the structure of the rock.

Another class of measurements and modeling techniques known as 'Earth Modeling' have been developed for specific purposes, such as when the rock layers are thin, or wells are drilled at high angles. This involves defining the boundaries between different layers of rock and then using the optimizing technique described earlier to determine the different minerals and fluids in the layers. Recent versions of this technique have also taken into account the directionality of the measurements and the impact of surrounding layers on the measurements.

However, Earth Modeling techniques face the problem that the rock layers are often too thin to distinguish, because they are thinner than the resolution of the measurements. If the layer boundaries are not correctly identified, there may be a possibility of multiple solutions, all of which give good matches to the input logs, but may mistakenly predict the wrong quantities of hydrocarbon in these layers. These modelling techniques are sometimes referred to as 'high resolution techniques' because they attempt to identify individual thin layers using the highest resolution log available and then model the layers defined.

In comparison, traditional deterministic and optimizing techniques can be considered low resolution, because they are defining rock composition over a given volume and ignoring the bed boundaries, individual layers and structural character in the rocks.

In embodiments of the present invention described herein, 3D Formation Evaluation (3DFE) may be used to model a rock formation more accurately, taking into account not only the minerals and fluids present, but also the structure of the rock, formation properties, or rock types, by using directional measurements. 3DFE modeling of geological cells is a "low resolution technique", so the individual beds are not defined. Furthermore, rather than defining the individual minerals and fluids present in the formation, this technique defines the content in terms of rock types, or rock components, with a measure of the degree of mixing of components in each direction fundamental to the model. From these rock components, the porosity, permeability and fluid content can be determined with greater accuracy than with conventional models. Petrophysicists may upscale the 3DFE models of the geological cells and incorporate them into a larger scale reservoir model as will be described later.

Figure 2:
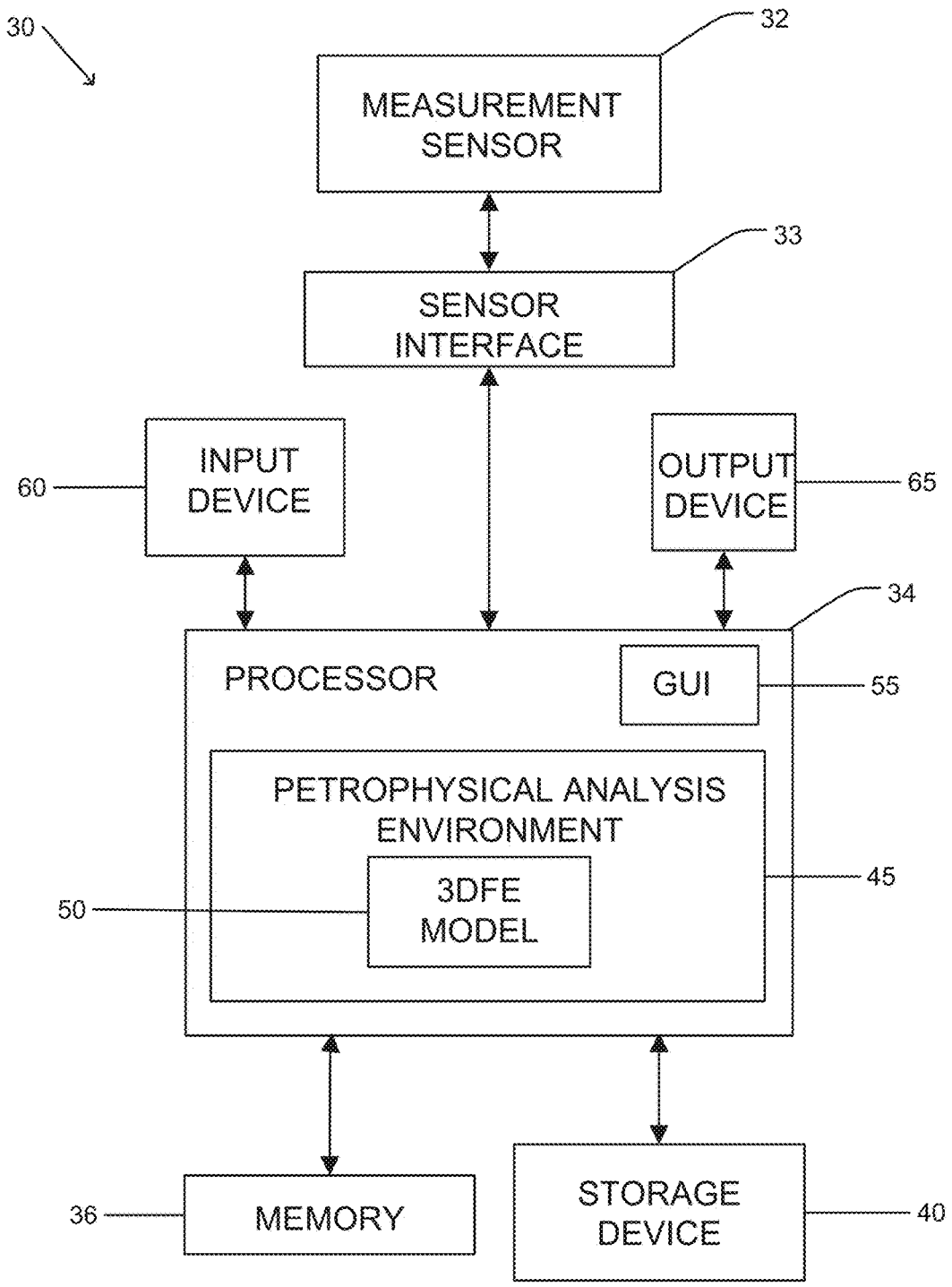
FIG. 2 schematically illustrates a system for measuring and modeling petrophysical properties of an oil reservoir, in accordance with some embodiments of the present invention.

FIG. 2 schematically illustrates a system 30 for measuring and modeling petrophysical properties of an oil reservoir, in accordance with some embodiments of the present invention. System 30 includes a processing unit 34 (e.g., one or a plurality of processors, on a single machine or distributed on a plurality of machines) for executing a method according to some embodiments of the present invention. A measurement sensor 32 which measures the different measurements data that are used to characterize and evaluate the rock formation communicates with processor 34 via a sensor interface 33. Sensor 32 may not only include log measurement sensors and logging tools, but also sensor and devices for analyzing rock and fluid samples taken at different depths from the wellbore during drilling.

Processing unit 34 is coupled to memory 36 on which a program implementing the methods described herein, and corresponding data may be loaded and run from and data may be saved, and a storage device 40, which includes a non-transitory computer readable medium (or mediums) such as, for example, one or a plurality of hard disks, flash memory devices, etc. on which a program implementing a method according to some embodiments of the present invention and corresponding data may be stored.

Processor 34 performs the functions of a petrophysical analysis environment (PAE) 45 in which a 3DFE model 50 is used in the petrophysical analyses as described herein. Processor 34 is configured to receive the data from measurement sensor 32 and used the data in PAE 45. The measurement data results may be stored in memory 36, in storage device 40, or in both.

System 30 includes an input device 60 for receiving data and instructions from a user, such as, for example, one or a plurality of keyboards, pointing devices, touch sensitive surfaces (e.g., touch sensitive screens), etc. for allowing a user (i.e., a petrophysicist) to input commands and data. System 30 further includes an output device 65 (e.g., display device such as CRT, LCD, LED, etc.) on which one or a plurality user interfaces associated with a program implementing a method according to some embodiments of the present invention and corresponding measurement data and model results may be displayed. The user inputs and data outputs from PAE 45 are controlled by a graphic user interface (GUI) 55. System 30 is shown in FIG. 2 by way of example for conceptual clarity and not by way of limitation of some embodiments of the present invention.

Some embodiments of the present invention may be implemented in the form of a system, a method or a computer program product. Similarly, some embodiments may be embodied as hardware, software or a combination of both. Some embodiments may be embodied as a computer program product saved on one or more non-transitory computer readable medium (or media) in the form of computer readable program code embodied thereon. Such non-transitory computer readable medium may include instructions that when executed cause a processor to execute method steps in accordance with some embodiments of the present invention.

In some embodiments, the instructions stored on the computer readable medium may be in the form of an installed application and in the form of an installation package. Such instructions may be, for example, loaded by one or more processors and executed.

For example, the computer readable medium may be a non-transitory computer readable storage medium. A non-transitory computer readable storage medium may be, for example, an electronic, optical, magnetic, electromagnetic, infrared, or semiconductor system, apparatus, or device, or any combination thereof.

Computer program code is written in programming language, and may be executed on a single computer system, or on a plurality of computer systems.

Figure 3:
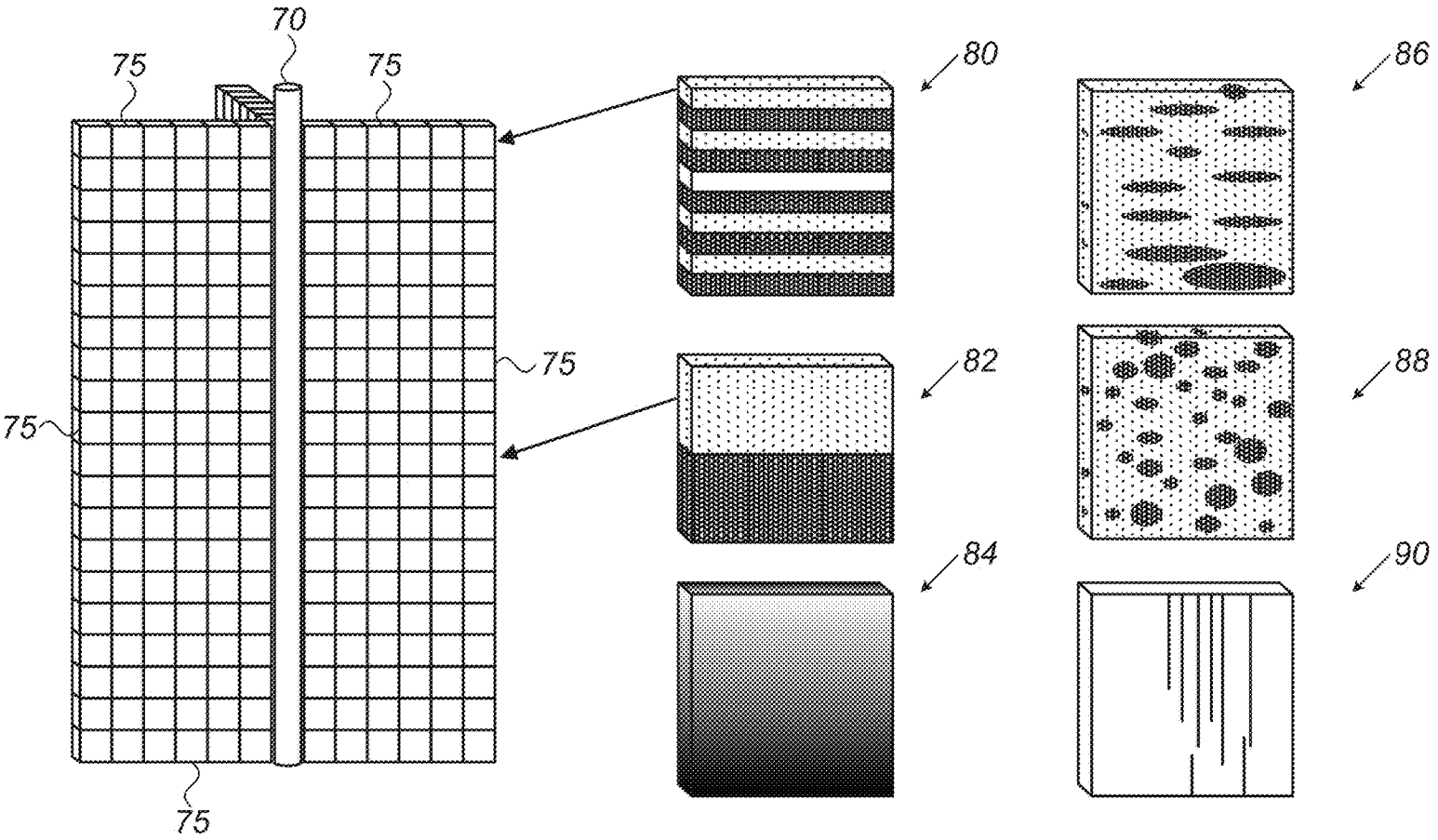
FIG. 3 is an illustration showing a wellbore and geological cells used in a 3D Formation Evaluation (3DFE) model, in accordance with some embodiments of the present invention.

FIG. 3 is an illustration showing a wellbore 70 and geological cells 75 used in the 3DFE model, in accordance with some embodiments of the present invention. There are two different aspects of the 3DFE model: First, wellbore 70 typically has a diameter of e.g., 6-12". Geological cells 75 including different rocks types are defined around the wellbore and typically up to e.g., 60-90" away from the center of wellbore. Geological cells 75 are typically (e.g., 6") cubes (or polyhedral), and they form the "basic building block" of the 3DFE model. Geological cells 75 are defined along the depth of wellbore 70 as shown in FIG. 3.

The specific output from the model as described later may include cell properties. There may be one cell per depth unit of the well. For example, there may be one cell for every e.g., 0.1524 m (6") along the measured or vertical depth of the well. There may be a plurality of, e.g., 1, 4, 6 or 8, cells around the borehole wall at every depth depending on the options chosen for the 3DFE model. Furthermore, there can be arrays of cells radially away from the borehole wall, either in one of the plurality of, e.g., 1, 4, 6 or 8, directions. These typical, example dimensions and directions away from the wellbore stated above are merely for conceptual clarity and not by way of limitation of some embodiments of the present invention. Any suitable dimensions and directionality may be used for the 3DFE model.

In some embodiments of the present invention, the second aspect of 3DFE model is that geological cell 75 is defined by percentages, or more generally a distribution of component rock types, and not by percentages of minerals and fluids. Typically the rock types are characterized on the basis of mineralogy, porosity and permeability. These rock types also may have a degree of mixing or separation in different directions, leading to different degrees of measurement anisotropy in each direction, which are defined in the model using anisotropy indices, for example, transverse (TAI) and azimuthal anisotropy (AAI) indices. An anisotropy index set to e.g., 0 indicates that the components are mixed and there is no anisotropy in that direction. An anisotropy index set to e.g., 1 indicates the components are not mixed and that they are either layered, in the horizontal sense, or there are fractures and vertical discontinuities in the azimuthal sense.

For the examples shown in FIG. 3, geological cells 80, 82, 84 have AAI=0 and TAI=1, geological cell 86 has AAI=0 and TAI=0.5, geological cell 88 has AAI=0, TAI=0, and geological cell 90 has AAI=1, TAI=0. The rocks shown in example geological cells 80, 82, 84, 86, and 88 include clastics, mixtures of sandstone (light shading) and shale (dark shading). Cell 90 includes fractured carbonate. In other embodiments, anisotropy indices may vary on a continuous scale defining a continuous range of rock type anisotropy values, and/or the directional indices for rock type anisotropy may vary on a continuous scale of angles or orientations (e.g., 0-180 degrees).

In an example of a rock composed of 1 cm thick layers of shale and sand, a conventional interpretation would define the volume percentage of shale, or clay minerals, the volume percentage of quartz minerals, and the percentages of different fluids occupying the pore space. These values would be the same regardless of the structure of the rock, so if the rock had been deformed or mixed in any way it would not be reflected in the result. Using high resolution modelling techniques it would typically be impossible to define the 1 cm thick layers so these systems would revert to conventional methodologies.

There are some low resolution modelling techniques available which would use measured electrical anisotropy to define the nature of the thin beds, but these require specific input measurements and they are restricted to simple models including only two layer types. No changes in the layer types can be handled and no third layer type is admissible.

With 3DFE, the user may select the layer types possible and define their properties. Hence, for this example the user would select sand and shale layers. They would then select the degree of anisotropy (e.g., using an anisotropy index from 0 to 1) in each direction. For this example the transverse anisotropy, which is the difference in measurements between the vertical and horizontal planes, would be set to 1 because the layers are distinct and there is no mixing between them. The azimuthal anisotropy, which is the difference in measurements along different horizontal directions, would be set to 0 because the layers are laterally continuous (e.g., cell 80 in FIG. 3).

In some embodiments of the present invention, system 30 will then use the available log measurements and inversion processing as described later to identify the relative proportion of the shale and sand layers. If there are changes in the nature of the sand layers then the user can input different sand types as different components. Thus, many more than the simple two components seen in conventional 'low resolution' thin bed modelling systems can be interpreted.

Defining the hydrocarbon in place in the sand layers depends on the data available. If conductivity measurements are available in both horizontal and vertical directions, then these can be used in the inversion process (e.g., optimization iteration loop described later) to get the best results. If only horizontal measurements are available then the results will be subject to a greater degree of uncertainty. If no usable conductivity measurements are available then fluid saturations based on capillary pressure data from core samples, along with permeability interpretation from the model may be used.

Another case of a thin-bedded reservoir includes no shale, but just different types of clean sand, some of which are very permeable and oil bearing, while others have low permeability, and are water bearing. In this case, the electrical conductivity measurements are not useful, because the results are dominated by the water bearing layers. Furthermore, the layers are too thin to be individually distinguished by the logs. In order to derive the properties for this reservoir, the types of sandstone present are defined and the relative amounts of each type of sandstone are determined at each depth in the reservoir. The characteristics of the sandstone layers are taken from core descriptions and the differentiation in the inversion model is mostly driven by the pore size information derived from the magnetic resonance measurements. From core photographs or image logs, if the formation is determined to be layered, the transverse anisotropy index is set to 1 and the azimuthal index is set to 0.

System 30 then defines the amounts of each sandstone type and the approximate permeability for each sand type is known, so the permeabilities from the thin beds can be upscaled to the cell and log response scale. With different permeabilities in non-mixed layers, the saturation height function is split based on the presence of different layer types. This is not possible in existing modelling systems because high resolution techniques cannot differentiate the thin layers and other low resolution systems, such as conventional techniques cannot divide the permeability measurement into different components. The only way to verify that the system is working in this case is by matching the hydrocarbon saturations with the fluorescence on the core photographs, and verifying that a good match is obtained.

To illustrate the entire flow in determining the distribution of rock types in geological cells 75, an exemplary case is considered here in Table I. Table I below is an example of characterizing geological cells 75 with the different rock types denoted RT in Table I:

TABLE I

Example of Rock Types Properties for Characterizing Geological Cells

| Rock Type (RT) | Porosity (Φ) and Permeability (κ) | Petrographic Summary | Notes |
|---|---|---|---|
| RT1 | Φ = 21.5%<br>κ = 1750 mD | Coarse to very coarse grained sandstone (mean grain size of 0.62 mm) | Reservoir quality rock |
| RT2 | Φ = 21.5%<br>κ = 963 mD | Medium to coarse grained sandstone (mean grain size of 0.51 mm) | Reservoir quality rock |
| RT3 | Φ = 20.0%<br>κ = 98 mD | Fine to medium grained sandstone (mean grain size of 0.21 mm) | Reservoir quality rock |
| RT4 | Φ = 17.0%<br>κ = 2.8 mD | Fine to medium grained sandstone (mean grain size of 0.18 mm) | |
| RT5 | Φ = 13.8%<br>κ = 0.2 mD | Very fine grained sandstone (mean grain size of 0.09 mm)<br>Includes a large amount of detrital matrix clays | |
| RT6 | Φ = 7%<br>κ = 0.002 mD | Sandy siltstone includes a large amount of detrital matrix clays<br>Most of the intergranular pores are completely filled up by detrital clays<br>No visible porosity | |

Rock layers with rock types of high porosity and high permeability are typically indicative of a layer in which hydrocarbons are trapped (e.g., reservoir quality rock). Similarly, rock layers with low porosity and low permeability are not indicative of layers with trapped hydrocarbon.

The complexity of the model can vary depending on the formation and the data available. In some cases, one cell 75 at each depth in the wellbore 70 can be assessed. The assumption is then made that all cells around the wellbore and away from the wellbore at that depth are the same. In other cases, if the data is available, a full set of cells are defined for each depth.

A difference between 3DFE and methods described previously is that 3DFE is a "low resolution technique" such that there is no need to define individual beds and their properties. This makes it much more "user friendly" and also applicable in more different petrophysical scenarios. Low resolution techniques may also increase computational speed (e.g., performing fewer computations) and reduce computational storage (e.g., storing lower resolution data) compared to high resolution techniques.

Figure 4:
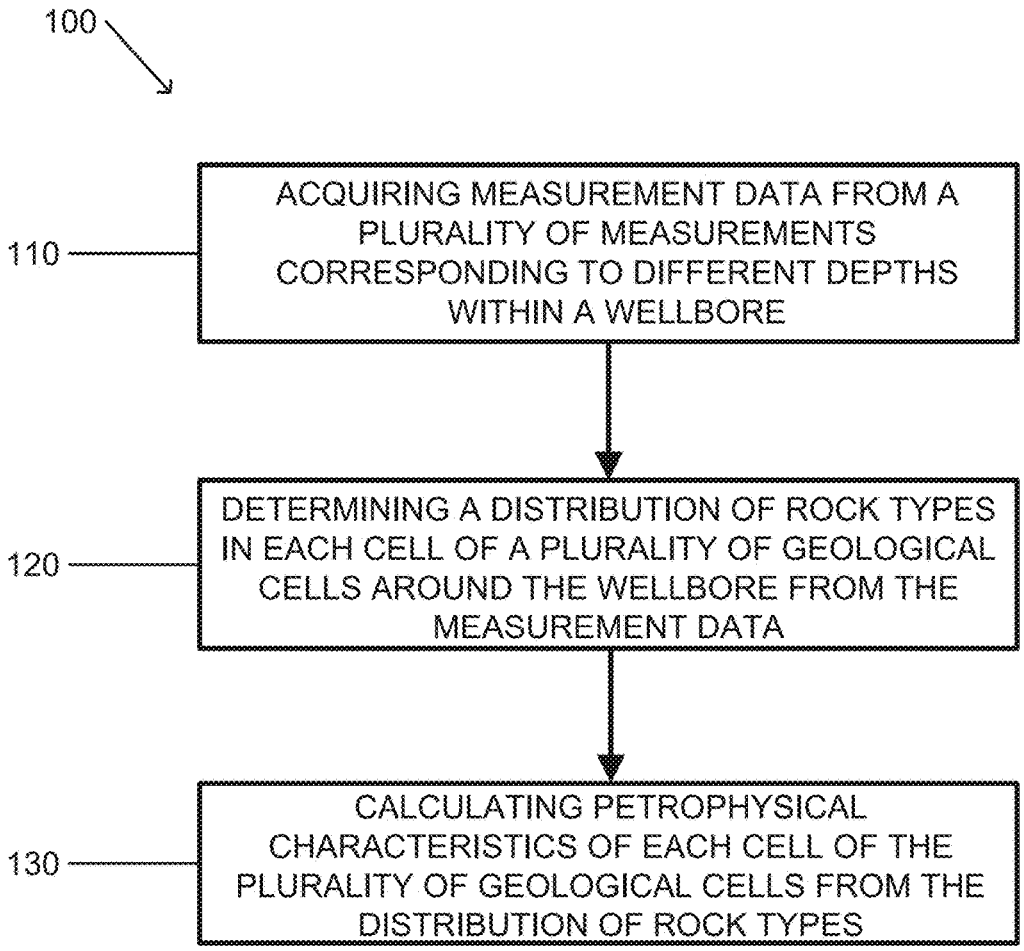
FIG. 4 schematically illustrates a method for determining a distribution of rock types in a plurality of geological cells around a wellbore, in accordance with some embodiments of the present invention.

FIG. 4 schematically illustrates a method 100 for determining a distribution of rock types in a plurality of geological cells around a wellbore, in accordance with some embodiments of the present invention. Method 100 includes acquiring 110 measurement data from a plurality of measurements corresponding to different depths with wellbore 70 using measurement sensor 32. Method 100 then includes determining 120 a distribution of rock types in each cell of a plurality of geological cells 75 around wellbore 70 from the measurement data. Finally, method 100 includes calculating 130 petrophysical characteristics of each cell of the plurality of geological cells 75 from the distribution of rock types (e.g., example of Table I).

An example to illustrate the 3DFE model flow is now described herein, in accordance with some embodiments of the present invention. An assessment of the available measurement data is first made on the rock formation to be evaluated. A determination of the rock types present is made and the measurements that can be used to distinguish those rock types as shown in the example of Table I. Each individual rock type may be distinguishable by different measurements, and if two or more rock types are similar then a distinguishing measurement may be found. In the following example, for simplicity AAI=0 and TAI=1. The component property coefficients (CP1 . . . CP5) shown in Table II are examples of layers that may include by rock types RT1-RT6 in Table I:

TABLE II

Rock Types and Components Properties

| PROPERTIES: | | KH | CBW | PcBW | FFV1 | FFV2 | PHIT | GR | NPHI | RHOB |
|---|---|---|---|---|---|---|---|---|---|---|
| CP1 | RT 6 | 0.01 | 0.07 | 0.00 | 0.00 | 0.00 | 0.07 | 135 | 0.39 | 2560.00 |
| CP2 | RT 5 | 0.1 | 0.13 | 0.00 | 0.00 | 0.00 | 0.13 | 120 | 0.31 | 2450.00 |
| CP3 | RT 4 | 1.00 | 0.04 | 0.17 | 0.00 | 0.00 | 0.21 | 80 | 0.18 | 2303.50 |
| CP4 | RT 3 | 100.00 | 0.00 | 0.05 | 0.17 | 0.00 | 0.22 | 75 | 0.19 | 2287.00 |
| CP5 | RT's 1 & 2 | 1000.00 | 0.00 | 0.05 | 0.10 | 0.10 | 0.25 | 65 | 0.22 | 2237.50 |

Table II is an example illustrating the sample component coefficients (CP1, . . . , CP5) of geological cell 75 whose properties to rock types RT1 . . . RT5 in Table I. The parameters shown in the table are the bulk parameter values whose values are defined below:

KH=horizontal permeability
CPW=clay bound water
PcBW=capillary pressure bound water
FFV1=free fluid volume 1 (small pores)
FFV2=free fluid volume 2 (large pores)
PHIT=total porosity
GR=gamma ray
NPHI=neutron porosity
RHOB=bulk density of the rock The four porosity parameters (FFV1, FFV2, NPHI, and PHIT) are measured by nuclear magnetic resonance.

Table III shows seven log measurements (e.g., at seven depths in the wellbore) which include measurements of the same metrics of the rock types shown in Table II (MD=measured depth (in meters)):

TABLE III

Seven Input Log Measurements used in the modeling example

| | INPUT LOGS | | | | | | |
|---|---|---|---|---|---|---|---|
| MD | GR | NPHI | RHOB | CBW | PcBW | FFV1 | FFV2 |
| 2987.65 | 86 | 0.229 | 2288.750 | 0.040 | 0.065 | 0.066 | 0.039 |
| 2987.80 | 86 | 0.229 | 2288.750 | 0.040 | 0.065 | 0.066 | 0.039 |
| 2987.95 | 86 | 0.229 | 2288.750 | 0.040 | 0.065 | 0.066 | 0.039 |
| 2988.11 | 86 | 0.229 | 2288.750 | 0.040 | 0.065 | 0.066 | 0.039 |
| 2988.26 | 80 | 0.225 | 2282.575 | 0.048 | 0.035 | 0.120 | 0.045 |
| 2988.41 | 80 | 0.225 | 2282.575 | 0.048 | 0.035 | 0.120 | 0.045 |
| 2988.56 | 80 | 0.225 | 2282.575 | 0.048 | 0.035 | 0.120 | 0.045 |

In some embodiments of the present invention, geological cells 75 at the seven measured depths (MD) shown in Table III are characterized in terms of a distribution of rock types given in each of geological cells 75. In some embodiments, the distribution includes percentages of rock types. However, these percentages are the parameters to be determined in the 3FDE model as described below. In that these parameters represent percentages of the rock types for this example, the sum of CP1+ . . . +CP5=1. Coefficients are assigned to each rock type in the plurality of geological cells 75. An initial guess of the coefficients are made at each depth as shown in Table IV before optimization:

TABLE IV

Initial guess of Rock Type percentages

| MD | CP1 | CP2 | CP3 | CP4 | CP5 | SUM |
|---|---|---|---|---|---|---|
| 2987.65 | 0.00 | 0.20 | 0.22 | 0.13 | 0.45 | 1.00 |
| 2987.80 | 0.00 | 0.20 | 0.22 | 0.13 | 0.45 | 1.00 |
| 2987.95 | 0.00 | 0.20 | 0.22 | 0.13 | 0.45 | 1.00 |

TABLE IV-continued

Initial guess of Rock Type percentages

| MD | CP1 | CP2 | CP3 | CP4 | CP5 | SUM |
|---|---|---|---|---|---|---|
| 2988.11 | 0.00 | 0.20 | 0.22 | 0.13 | 0.45 | 1.00 |
| 2988.26 | 0.00 | 0.19 | 0.00 | 0.39 | 0.42 | 1.00 |
| 2988.41 | 0.00 | 0.19 | 0.00 | 0.39 | 0.42 | 1.00 |
| 2988.56 | 0.00 | 0.19 | 0.00 | 0.39 | 0.42 | 1.00 |

TABLE V

Initial values of petrophysical parameters computed before optimization

| MD | GR | NPHI | RHOB | CBW | PcBW | FFV1 | FFV2 |
|---|---|---|---|---|---|---|---|
| 2987.65 | 80.60 | 0.225 | 2301.0 | 0.035 | 0.067 | 0.067 | 0.045 |
| 2987.80 | 80.60 | 0.225 | 2301.0 | 0.035 | 0.067 | 0.067 | 0.045 |
| 2987.95 | 80.60 | 0.225 | 2301.0 | 0.035 | 0.067 | 0.067 | 0.045 |
| 2988.11 | 80.60 | 0.225 | 2301.0 | 0.035 | 0.067 | 0.067 | 0.045 |
| 2988.26 | 79.33 | 0.225 | 2297.1 | 0.025 | 0.041 | 0.109 | 0.042 |
| 2988.41 | 79.33 | 0.225 | 2297.1 | 0.025 | 0.041 | 0.109 | 0.042 |
| 2988.56 | 79.33 | 0.225 | 2297.1 | 0.025 | 0.041 | 0.109 | 0.042 |

The next step in computing the percentages of rock types in geological cells 75 is to create a linear combination of the coefficient (e.g., percentage) of rock type and the theoretical value in Table II for a given metric (e.g., a synthetic log), which is shown in Table V. For example, the value of GR is found from theoretical values of GR (e.g., 135, 120, 80, 75, 65) for CP1 . . . CP5 in Table II and the initial guess of the coefficients CP1 . . . CP5 from Table IV. Stated differently, GR in Table V is given e.g., by:

$$GR=(CP1*135)+(CP2*120)+(CP3*80)+(CP4*75)+(CP5*65) \quad (1)$$

and using the initial values of the coefficients in Table IV in Equation (1) yields the value of e.g., GR=80.60 in Table V.

However, the value of e.g., GR=80.60 is a theoretical computed value determined by the initial estimate of the coefficients CP1 . . . CP5, or the percentages of rock types at depth 2987.65 m. To determine the actual percentages, the measured GR=86 from the log measurements at a measured depth of 2987.65 m in Table III can be used to determine the actual percentage as follows. Applying the same methodology above is applied to each of the seven petrophysical metrics shown in Table III (e.g., GR, NPHI, RHOB, CBW, PcBW, FFV1, and FFV2) yields seven equations similarly to Equation (1) each with the coefficients (CP1 . . . CP5).

Error functions including the difference between the theoretical values of each of the seven petrophysical metrics as given in Equation (1) is taken from Table II and the measured log data in Table III are computed for each of the seven parameters, or petrophysical metrics. The sum of the squares of these difference functions, which are normalized to give each petrophysical parameter the same weight in the error function, can then be iteratively minimized by varying the coefficients CP1 . . . CP5. The results of the percentages of the rock type in each of geological cells 75 at each of the measured depths can be determined by this procedure along with synthetic log response curves for each log.

This optimization technique described above, known as inversion processing, involves starting with the selected model components in a certain distribution, computing the log responses for that component distribution, calculating the difference (or error) between computed and actual responses and mathematically determining the changes to be made to the model distribution in order to minimize those calculated errors. The process is then iterated until the errors cannot be further minimized.

In some embodiments of the present invention, once the coefficients, or percentages or rock types, or more generally the distribution of rock types are determined in each of geological cells 75, the percentages are used to calculate petrophysical characteristics of each of the geological cells, and subsequently the petrophysical characteristics of the part of the reservoir penetrated by the wellbore. The typical petrophysical characteristics or metrics computed from the distribution of rock types include porosity, permeability, fluid saturation, net pay and net reservoir.

In some embodiments of the present invention, if there is a gradual change in characteristics of a certain rock type within the formation then two or more 'end point components' may be used and the change will be reflected by a change in the percentages of the end point components in the solution. Care must be taken not to pick too many components. Mathematically, there is a limit to the number of rock components that can be resolved, this being one more than the number of measurements used (e.g., in accordance with the linear combination as shown by example in Equation (1)). The model should be kept as simple as possible in order to accurately derive the formation properties.

The example embodiment illustrated in Tables II-V is merely for conceptual clarity and not by way of limitation of the embodiments of the present invention. The example shown above is simplistic optimizing using only seven log measurements with transverse anisotropy and no azimuthal anisotropy. Other numbers of log measurements may be used.

In some embodiments of the present invention, the petrophysicist assesses which method is going to be used to define fluid content, based on measurements available and the formation type. If resistivity data is to be used, then there are three possible model types:

- Model A: Rock components are quantified using hydrocarbon corrected log data and conventional saturation equations are used for fluid saturations.
- Model B: Tri-axial measurements or measured electrical anisotropy are used to simultaneously define the components and fluid content.
- Model C: Rock components including different fluid types are characterized separately and the resulting mix defines the amount of each fluid present.

If resistivity measurements are not used in the model, then an alternative, such as a saturation height function, may be used. If this approach is chosen, then all effects of hydrocarbon may be removed from those logs affected by it, such as neutron and density logs. There are various techniques already available to do this. The model then uses the components present to define a 'rock fabric' and the saturation height function is used to determine fluid saturations.

This highlights major differences between previous techniques and the 3DFE model presented herein. Resistivity Model A, above, is different from existing techniques in that rock components, rather than mixtures of minerals and fluids, are being defined. Some modeling processes do define rock types, but tend to define a single rock type over a depth range. In this technique, a range is defined as being made up of different types of rock, such as thin beds of multiple types or a gradual change from one extreme of a rock type to another or even, for some complex carbonates, the rock could be made up of separate porous matrix, vugs and fractures. These are termed 'rock components' and they are quantified in each cell. The properties for the complete rock are then derived using any conventional petrophysical technique.

Model B is different because previous thin bed techniques using electrical anisotropy are restricted to two layer types, usually sand and shale. These techniques can be termed low-resolution, because each individual layer is not defined but the restriction to a binary system limits their use to a specific type of formation.

Model C is a new technique which is made possible by low resolution 3D modelling (3DFE). This could not be performed while differentiating the minerals and fluids in a reservoir which works only when actual rock types and their properties are defined.

The last approach described, where resistivity data is not used, can be very difficult to implement in certain cases, especially when permeability is the key to the saturation height function and the separate components give complex permeability values at any given depth.

In some embodiments of the present invention, log blocking may be used in some formation types. This is the case when there is a notable difference in the log characteristics over bed boundaries based on the vertical resolution of the each log. If a high resolution log shows a sharp boundary at the same place as a low resolution log shows a smooth transition then the logs should be blocked, using one of the conventional techniques available, in order to resolution match the curves.

If very thin beds are present this is not necessary because the resolution of logs will never be high enough to block to thin bed resolution, but if the thickness of the beds is greater than about 15 to 20 cm, and there is significant contrast between log responses in the beds, then blocking is advisable.

In some embodiments of the present invention, different techniques may be applied to determine actual spatial distributions of the different rock types with the volume of geological cells 75. For example, this would be useful in cases of thin layered rock types within each of geological cells 75 for use in the 3DFE model.

In some embodiments of the present invention, once the first pass of the model is complete, the petrophysicist (e.g., user of system 30) may assess whether the results are sufficiently accurate, or whether fine tuning the model would improve the results. The type of fine tuning available involves either changing the number or mix of components, or changing the properties and log responses to each component. Once the petrophysicist is satisfied that 3DFE model 50 cannot be realistically improved, the final results are then generated, reported on output device 65, and used in other simulations performed in petrophysical analysis environment 45.

In some embodiments of the present invention, the model can then be constructed for one well and used as a starting point for other nearby wells in the same formation. The three dimensional aspects of the model also make it useful for other applications, such as geosteering high angle and horizontal wells and upscaling of petrophysical results into reservoir models as will be described later.

The outputs are detailed petrophysical properties, or characteristics, of reservoir units as determined only for wellbore 70, which can be applied to build a larger scale reservoir model by upscaling. A reservoir model is a three dimensional computer based representation of a reservoir. It is made up of cells, each with properties for that part of the reservoir. Once the 3DFE model has been determined, the information to populate cells in a reservoir model is available. That information relates to cell sizes which are considerably smaller than the cells in a reservoir model, however, depending on the nature of the reservoir formation, a form of 'upscaling' can be applied from the wellbore cells. Upscaling is a mathematically correct form of combining the components in each cell so that the property used for the reservoir model cell can be derived from the same properties which populate the wellbore cells which lie within the reservoir model cell.

Some of these properties, such as porosity, are not affected by the directionality in which they are measured so they can be upscaled in a conventional method using basic averaging. However, other properties, such as permeability, are strongly affected by the direction in which they are measured such that directionality is accounted for in upscaling the cells. The properties derived from the 3DFE modelling can be used to populate the reservoir model at the wellbore and the structural information can then be used to define the properties between the wells. Specifically, the upscaled distribution of rock types in the plurality of geological cells 75 may be mapped into the reservoir model.

In some embodiments of the present invention, the output data is in digital data format, which can be used by specialists in industries such as the upstream petroleum industry, carbon sequestration, geothermal power, etc. The output data may be presented in different forms and formats depending on the use of the application as described below.

A 'reservoir summary' is a listing of the individual reservoir units, layers, intervals or formations, and is common to all forms of petrophysical interpretation. Essentially, a reservoir summary of an oil reservoir is made using the reservoir model with the upscaled distribution of rock types. There are some variations in the detail of summaries, but in general, the listing typically gives the following information for each unit:

- Top Depth, Bottom Depth, Gross thickness
- Definition of 'net reservoir' and 'net pay' which are the parts of the interval that are considered reservoir quality rock and reservoir quality rock including quantities of hydrocarbon, respectively. The definitions are based on cutoff parameters supplied by the petrophysicist. These can be minimum thickness, maximum shale content, minimum porosity and/or minimum permeability for net reservoir and the same values along with maximum water saturation for net pay.
- Net to Gross ratios for net reservoir and net pay
- For the net reservoir and net pay in each unit the average property values are usually noted, including average shale volume, average porosity (total and effective), average and geometric mean permeability and, for net pay, the average water saturation
- The amount of hydrocarbon in place in one dimensional sense, expressed as hydrocarbon pore fraction or equivalent hydrocarbon column If full uncertainty modelling has been done all of these figures will be given for the 'base case', the mean case, and the cases corresponding to e.g., the 10th, 50th and 90th percentiles of hydrocarbon in place. This information is used to populate the reservoir model for field development planning, economic assessment and for reservoir simulation.

In some embodiments of the present invention, an output report is created by system 30 detailing the interpretation methods and parameters used, the input logs, corroborating or verifying information such as from core tests, multiple interpretation techniques which are in agreement or other wells from the same formation with similar results. The report may also include one or more plots supporting the interpretation methods and results. The plots of the results usually show the input logs and the calculated curves such as shale volume, total and effective porosity, permeability, fluid types and saturations, rock types, test results, pressure information, verifying core information, cuttings and core descriptions, model generated synthetic curves (if any type of inversion has been used), along with any other relevant information that helps to explain the interpretation.

In some embodiments of the present invention, special plots to illustrate extended models will be used for cases where the three dimensional model has been extended around the wellbore, as well as for cases where the model has been extended away from the wellbore.

In some embodiments of the present invention, the output data may include three dimensional representations of the wellbore, or borehole, wall in a cylinder, which can be rotated on a computer screen and any aspect of the 3D representation can be plotted. They also include sections through the wellbore where differential invasion of drilling fluids may be shown e.g., by color coding.

In some embodiments of the present invention, the output data from the modelling process is stored in a digital database along with the input data and all other available information for the well.

In some embodiments of the present invention, some or all of the following information is stored in system 30 for 3DFE model 50 which include:

- Well name and information
- Intervals evaluated (start and end depths of each)
- Description and properties of model components used
- Description and properties of input data used
- Description and parameters for all interpretation techniques used within the model In some embodiments of the present invention, some of all of the following information is stored for each depth in the well (e.g., in wellbore 70):

- Depth, measured or true vertical depth in the well
- Location or offsets from a given starting point along with the relevant mapping projection
- Input data, including original and blocked logs, any array data such as images
- Other available data, such as cuttings descriptions, hydrocarbon shows and descriptions, mineralogy information from cuttings and core analysis, core photographs, core test data, pressure and formation test data In some embodiments of the present invention, some or all of the following information is stored for each geological cell 75:

Orientation of the cell properties

Anisotropic indices for each direction

Percentages of each component present

Calculated reservoir properties derived from the presence of each component (this is the information from which the reservoir summary described above is derived)

Synthetic log responses calculated for each cell for each input log or array used Error or difference between the synthetic and actual log responses In some embodiments of the present invention, the reservoir model includes not only well-based data (e.g., on single wellbore 70), but also geological and geophysical interpretations of other available data. Thus, the reservoir model includes geological characterization between the wells (e.g., wells 12 and 20 in FIG. 1).

The resulting reservoir model can then be used as a starting point for building a new 3DFE model along the planned trajectory of a new high angle well. As the well is drilled, the existing model is compared to the data recorded from the new well, thereby allowing the drillers to be able to steer the new well with greatly increased confidence than previously available. This is a process known as 'geosteering'.

If horizontal well 12 is about to be drilled through a reservoir, the drillers may need to know whether or not wellbore 14 is being drilled through oil bearing layer 15 and, if not, whether to change direction of the well up or down. Essentially, the reservoir model with the upscaled distribution of rock types may be used to compute an angle or trajectory for drilling the well. Furthermore, when the well is complete, a petrophysical evaluation would be used to determine reservoir property changes across the field.

Conventional petrophysical analyses are typically problematic in high angle wellbores, because the measurements are affected by anisotropy at different values of high angles compared with the same formation drilled vertically. Therefore, if an interpretation model is derived for vertical wells, it will typically have to be changed considerably to interpret data from the high angle well. This means that for geosteering purposes, conventional techniques are cumbersome to use. Existing three dimensional modeling can work in high angle wells and for geosteering, but typically only if the beds are thick enough and can be clearly defined.

3DFE is a lot easier to use in these circumstances because a model built from data from a vertical well can easily be used as a starting point for the high angle well. As the three dimensional characteristics of the cells are already modelled, a section based on that well and the seismic survey can be used to define the expected formations encountered. As new data is recorded along the path of the high angle well the model and section are updated accordingly.

Embodiments of the invention may manipulate data representations of real-world objects and entities such as underground geological structures of the Earth, including faults, horizons and other features. Data received by for example a receiver receiving waves generated by an air gun or explosives may be manipulated and stored, e.g., in memory 36 or storage device 40 in FIG. 2, and data such as images representing underground structures may be presented to a user, e.g., as a visualization on output device 65 in FIG. 2.

It should be understood with respect to any flowchart referenced herein that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other embodiments of the illustrated method.

Similarly, it should be understood that, unless indicated otherwise, the illustrated order of execution of the operations represented by blocks of any flowchart referenced herein has been selected for convenience and clarity only. Operations of the illustrated method may be executed in an alternative order, or concurrently, with equivalent results. Such reordering of operations of the illustrated method should be understood as representing other embodiments of the illustrated method.

Different embodiments are disclosed herein. Features of certain embodiments may be combined with features of other embodiments; thus certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A method comprising:

acquiring measurement data from a plurality of measurements corresponding to different depths within a wellbore;

using a processor, determining from the measurement data, a distribution of rock types in each cell of a plurality of geological cells around the wellbore;

calculating petrophysical characteristics of each cell of the plurality of geological cells from the distribution of rock types;

upscaling the determined distribution of rock types in the plurality of geological cells; and mapping the upscaled distribution to a reservoir model.

2. The method according to claim 1, wherein the plurality of measurements comprise log measurements at the different depths within the wellbore collected by sensors lowered into the wellbore.

3. The method according to claim 1, wherein the plurality of measurements comprise measurements made by sensors of a plurality of geological samples removed from the wellbore corresponding to different depths in the wellbore.

4. The method according to claim 1, wherein determining the distribution of rock types in each cell of the plurality of geological cells comprises:

assigning coefficients to each rock type within each of the plurality of geological cells;

computing an error function including a difference between a petrophysical metric as derived from the measurement data and the petrophysical metric as computed from the coefficients; and minimizing the error function by varying the coefficients.

5. The method according to claim 1, wherein calculating the petrophysical characteristics comprises using the distribution in each of the plurality of geological cells to compute petrophysical parameters selected from the group consisting of: porosity, permeability, fluid saturation, net pay, and net reservoir.

6. The method according to claim 1, further comprising computing an angle for drilling a well by using the reservoir model with the upscaled distribution of rock types.

7. The method according to claim 1, further comprising outputting a reservoir summary of an oil reservoir by using the reservoir model with the upscaled distribution of rock types.

8. A system comprising:

a memory; and a processor configured to receive measurement data from a plurality of measurements corresponding to different depths within a wellbore, to determine from the measurement data, a distribution of rock types in each cell of a plurality of geological cells around the wellbore, to calculate petrophysical characteristics of each cell of the plurality of geological cells from the distribution of rock types, to upscale the determined distribution of rock types in the plurality of geological cells, and to map the upscaled distribution to a reservoir model.

9. The system according to claim 8, wherein the plurality of measurements comprise log measurements at the different depths within the wellbore collected by sensors lowered into the wellbore.

10. The system according to claim 8, wherein the plurality of measurements comprise measurements made by sensors of a plurality of geological samples removed from the wellbore corresponding to different depths in the wellbore.

11. The system according to claim 8, wherein the processor is configured to determine the distribution of rock types in each cell of the plurality of geological cells by assigning coefficients to each rock type within each of the plurality of geological cells, computing an error function including a difference between a petrophysical metric as derived from the measurement data and the petrophysical metric as computed from the coefficients, and minimizing the error function by varying the coefficients.

12. The system according to claim 8, wherein the processor is configured to calculate the petrophysical characteristics by using the distribution in each of the plurality of geological cells to compute petrophysical parameters selected from the group consisting of porosity, permeability, fluid saturation, net pay and net reservoir.

13. The system according to claim 8, wherein the processor is configured to compute an angle for drilling a well by using the reservoir model with the upscaled distribution of rock types.

14. The system according to claim 8, wherein the processor is configured to output a reservoir summary of an oil reservoir by using the reservoir model with the upscaled distribution of rock types.

* * * * *